United States Patent [19]

Boynton

[11] Patent Number: 4,792,013

[45] Date of Patent: Dec. 20, 1988

[54] VOCAL MUFFLER

[76] Inventor: Carter R. Boynton, 6820 Town Harbor Blvd., #3624, Boca Raton, Fla. 33433

[21] Appl. No.: 93,832

[22] Filed: Sep. 8, 1987

[51] Int. Cl.[4] ..... F01N 7/00

[52] U.S. Cl. ..... 181/242; 181/21

[58] Field of Search ..... 181/21, 22, 138, 242

[56] References Cited

U.S. PATENT DOCUMENTS

| | | | |
|---|---|---|---|
| 1,776,584 | 9/1930 | Gerlach, Jr. | 181/242 |
| 2,490,138 | 12/1949 | Kettler | 181/242 X |
| 3,796,842 | 3/1974 | Guille | 181/242 X |

*Primary Examiner*—B. R. Fuller

*Attorney, Agent, or Firm*—Henderson & Sturm

[57] ABSTRACT

A vocal muffler for muffling the vocalization of a human, especially a crying baby. The muffler comprises a globe-like member having a chamber provided with a port positionable over the baby's mouth and via which the baby's crying enters the chamber to exit through muffled port means in bypassing relation to an inhalation port. A valve in the chamber opens the inhalation port during inhalation by the baby and closes the port in response to exhalation. The bypassing port means includes sound-attenuating means for muffling the baby's cries. The valve is contained loosely in a cage adjacent to the inhalation port so that when the muffler is not used as a muffler, the ball will rattle in the cage and the muffler serves as a toy rattle.

13 Claims, 1 Drawing Sheet

VOCAL MUFFLER

BACKGROUND AND SUMMARY OF THE INVENTION

Many devices have been provided in the past for muffling the vocalizing of a human; e.g., to muffle voices during speech rehearsal, during the taking of testimony, etc. The present invention aims at muffling the cries of a baby, for example, without actually causing discomfort to the infant. By muffling the crying, especially during the night and early morning, picking up and walking the baby is avoided, a practice considered detrimental by some authorities on infant care. The muffler according to the present invention may be placed over the infant's mouth and held in place by an attending person. Provision is made so that the attending person's hand does not block air passages to and from the chamber within the muffler.

It is a significant feature of the invention to provide the muffler in the form of a globe-like member that is easily handled and further that may serve as a rolling or throwable toy, and especially as a toy rattle when not in use as a muffler. The member may be made of any suitable material, selected from among the known plastics, for example, thus providing a light-weight article that may be easily used and kept clean. It has no external moving parts, the only moving part being the internally disposed valve which cannot escape the hollow structure. The structure is provided with fixed, internal baffles which function as sound-attenuating means.

Further features will appear as a preferred embodiment of the invention is disclosed in the ensuing description and accompanying drawings.

DETAILED DESCRIPTION OF A PREFERRED EMBODIMENT OF THE INVENTION

Figure 1:
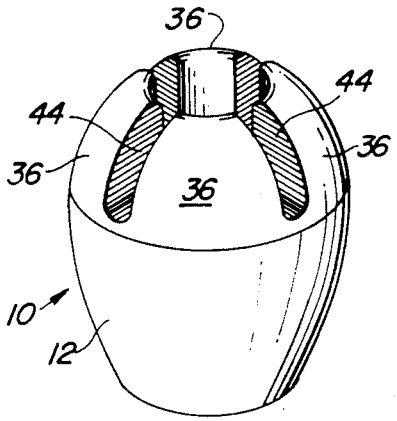
FIG. 1 is a perspective of the globe-like member.
Figure 2:
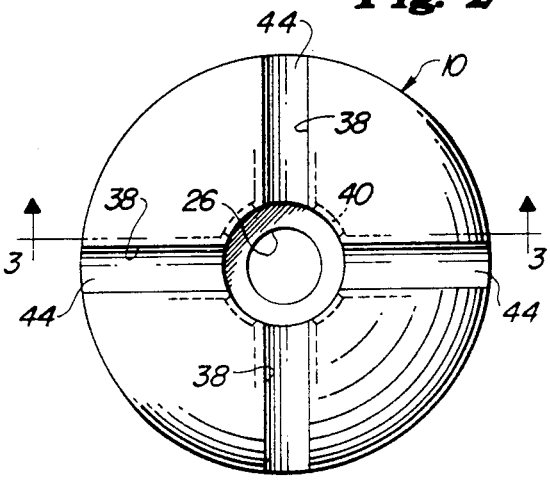
FIG. 2 is an enlarged plan view.
Figure 3:
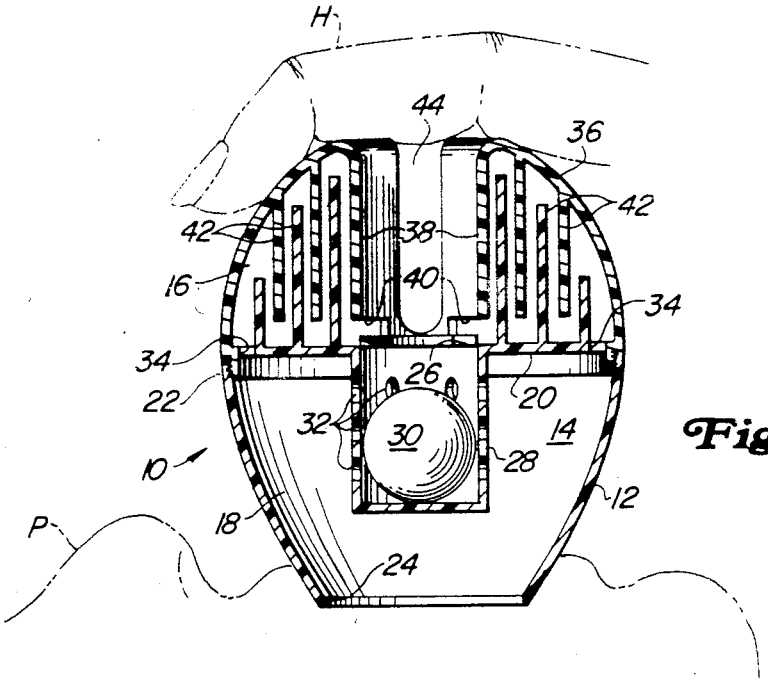
FIG. 3 is a section taken generally along the line 3—3 of FIG. 2

The muffler chosen for purposes of the present disclosure is shaped generally as a globe and, although not a perfect shape in the geometrical sense, is conveniently referred to here and in the claims in terms of "top," "bottom," "radial," etc., which terms, however, should not be construed as limiting the scope of the invention.

The structure as a whole is designated by the numeral (10) and has an exterior wall (12) that provides an internal chamber (14) which may be regarded as being divided into upper and lower halves (16) and (18) by a transverse partition (20). In one form of the invention, the upper and lower halves of the member may be secured together by screw threads (22); although, obviously other forms of design may be resorted to. The bottom part of the member (10) is provided with a port (24) adapted to be placed over the open mouth of a vocalizing person (P), such as a crying infant. The member is shown as being held in place by the hand (H) of an attending person. Thus the cries of the infant, including exhalations, enter the chamber lower half (18) and escape from the member in a manner to be described immediately below.

The partition, or that much of the member wall that provides part of the partition, is formed with a second port (26), preferably of circular shape. A valve cage

(28) is attached to and depends from the partition in vertical alignment with the port (26) and contains a valve in the form of a ball (30). The cage is formed in any suitable manner with a plurality of openings (32) so that when the ball is in its lower position as shown in FIG. (3), air entering through the uncovered port (26) may pass through the cage to the port (24), as in response to inhalation by the infant. It will be clear that the ball, in response to the infant's exhalation during crying, will move upwardly and close the port (26). In this respect, the ball is of light-weight, relatively hard material, as is the cage, and the ball is rather loosely received in the cage so that shaking of the member when not used as a muffler enables the member to serve as a toy rattle.

Since the valve ball closes that port (26) during exhalation of the crying infant, provision must be made for the escape of the exhaled air. This is accomplished by providing in the partition of a plurality of port means (34) which lead to the upper chamber (16), here shown as being formed as part of the exterior wall that is shaped as upper extensions or lobes (36), here four in number equally angularly spaced about the port (26). Each lobe has an inner upright wall (38) provided at its lower portion with an opening (40) adjacent to but outwardly beyond the port (26). Thus, each opening (34) and its companion opening (40) provide port means in bypassing relation to the port (26); that is to say, even though the port (26) is closed by the ball in its upper position, there is still communication from the interior chamber to atmosphere via this further port means (34,40).

Further, the lobes are provided interiorly with sound-attenuating means, here in the form of a plurality of baffles (42). As seen, these baffles are disposed in the path of outwardly moving air from the port (24) to atmosphere and thus serve to muffle the infant's cries. Of course, when the infant inhales, the ball drops to its lower position, uncovering the port (26) and allowing free passage of air through the valve cage to the port (24) for the inhalation function.

In order to avoid the possibility that the hand of the attending person will block air flow into and out of the member, the lobes are so spaced as to provide valleys (44) between them which serves as air passages leading to the further port openings (40) as well as to the port (26). Thus, there is free air passage to the port (26) for inhalation when the valve ball is in its open or down position. Obviously, the lobe passages and lobes themselves are designed so that the entire structure cannot be covered by the attendant's hand.

It is thought that the operation of the muffler will have become clear from the foregoing. Briefly, and by way of recapitulation, the member (10) is placed over the open mouth of the infant who is living on its back and the member is held in place lightly by the hand of the attending person. Inhalation and exhalation by the infant during crying are achieved via the valve port (26) and the further port means (34,40), respectively, the latter being muffled by the baffles (42). As already stated, the passages between the lobes prevent interference with free passage of air by the hand of the attending person.

It will be understood that the foregoing is based on a preferred embodiment and use of the invention and that many modifications may be made in that design and structure and other uses resorted to without departing from the spirit and scope of the invention.

I claim:

1. A vocal muffler for use by a human person, comprising a member having an exterior wall defining a chamber and provided with a first port opening to atmosphere and adapted to be placed over the mouth of a vocalizing person, said wall having a second port open to atmosphere and spaced from the first port, a valve cage within said chamber and supported by said wall adjacent to the second port, a valve movable in the cage in response to exhalation of said vocalizing person into the chamber though the first port to close the second port and movable upon inhalation by said person to open the second port, and said wall having further port means communicating the chamber to atmosphere in bypassing relation to the second port for conducting exhaled air out of the chamber during closure of the second port.

2. A muffler according to claim 1, including sound-attenuating means associated with the further port means.

3. A muffler according to claim 2, in which the sound-attnuating mean includes a plurality of baffles.

4. A muffler according to claim 1, in which the valve and cage are of relatively hard material and the valve is loosely received in the cage so that the member, when used other than a muffler, serves as a toy rattle.

5. A muffler according to claim 1 in which the wall includes an extension projecting outwardly beyond the second port and the extension includes inlet air passage means leading to the second port.

6. A muffler according to claim 5, in which the extension includes an auxiliary chamber, the auxiliary chamber includes the further port means, and sound-attenuating means is contained in the auxiliary chamber.

7. A muffler according to claim 1, in which the member is globe-like and has a transverse partition dividing the member into upper lower halves, the chamber, valve, valve cage, and first port are disposed in the lower half, the second port is in the partition, and the further port means includes a first opening in the partition and a communicating second opening in the upper half.

8. A muffler according to claim 7, including sound-attenuating means in the upper half intermediate the aforesaid two first and second openings of the further port means.

9. A muffler according to claim 7, in which the upper half is divided into a plurality of lobes spaced angularly about a vertical axis centered in the second port, the partition includes a plurality of first openings, one for each lobe and each lobe includes a second opening communicating respectively with the first openings, and said lobes including air passage means in addition to the further port means openings and leading to the second port means.

10. A muffler according to claim 9 in which the air passage means is provided by the angular spacing of the lobes.

11. A muffler according to claim 7, in which the upper portions of the lobes afford means for receiving a hand of a second person for enabling manual holding of the muffler by the second person over the mouth of the vocalizing person.

12. A muffler according to claim 7, in which the partition is part of the upper half and the two halves are separably interconnected generally in the plane of the partition.

13. The muffler according to claim 7, in which the valve cage is part of the partition and depends into the lower half.

* * * * *

UNITED STATES PATENT AND TRADEMARK OFFICE

CERTIFICATE OF CORRECTION

PATENT NO. : 4,792,013

DATED : December 20, 1988

INVENTOR(S) : Carter R. Boynton

It is certified that error appears in the above-identified patent and that said Letters Patent is hereby corrected as shown below:

Column 1, line 46, "shape" should be --sphere--; Column 2, line 56, "living" should be --lying--; Column 3, line 24 "attnuating" should be --attenuating--; Column 4, line 11 "aforesaid two first and second openings" should be --aforesaid first and second openings--.

Signed and Sealed this

Twenty-third Day of May, 1989

*Attest:*

DONALD J. QUIGG

*Attesting Officer*

*Commissioner of Patents and Trademarks*